US006405812B1

(12) United States Patent
Tibussek

(10) Patent No.: US 6,405,812 B1
(45) Date of Patent: Jun. 18, 2002

(54) DRILLING TOOL FOR THE AIR-LIFTING PROCESS

(75) Inventor: Fritz Tibussek, Monchengladbach (DE)

(73) Assignee: Wirth Maschinen-und Bohrgerate-Fabrik GmbH, Erkelenz (DE)

( * ) Notice: Subject to any disclaimer, the term of this patent is extended or adjusted under 35 U.S.C. 154(b) by 93 days.

(21) Appl. No.: 09/685,786

(22) Filed: Oct. 10, 2000

Related U.S. Application Data

(63) Continuation of application No. 09/214,585, filed as application No. PCT/DE97/00966 on May 14, 1997, now abandoned.

(30) Foreign Application Priority Data

Jul. 2, 1996 (DE) ..... 196 26 591

(51) Int. Cl.[7] ..... E21B 39/00
(52) U.S. Cl. ..... 175/393; 175/213; 175/215
(58) Field of Search ..... 175/215, 324, 175/213, 393

(56) References Cited

U.S. PATENT DOCUMENTS

| | | | | |
|---|---|---|---|---|
| 3,360,061 A | | 12/1967 | Canalizo | |
| 3,917,326 A | | 11/1975 | Grable | |
| 3,951,220 A | | 4/1976 | Phillips, Jr. et al. | |
| 4,195,700 A | * | 4/1980 | Worden | 175/340 |
| 4,200,160 A | | 4/1980 | Newcomb | |
| 4,296,824 A | | 10/1981 | Kennington | |
| 4,363,367 A | | 12/1982 | Dixon et al. | |
| 4,448,269 A | | 5/1984 | Ishikawa et al. | |
| 4,516,633 A | | 5/1985 | Richardson et al. | |
| 4,819,746 A | | 4/1989 | Brown et al. | |

FOREIGN PATENT DOCUMENTS

| | | |
|---|---|---|
| DE | 32 28 106 | 4/1985 |
| DE | 39 20 392 | 1/1991 |
| GB | 2243387 | 10/1991 |

* cited by examiner

*Primary Examiner*—Robert E. Pezzuto
*Assistant Examiner*—Meredith C. Petravick
(74) *Attorney, Agent, or Firm*—Vickers, Daniels & Young

(57) ABSTRACT

A drilling tool for drilling bore holes into the ground and for removing the drilled material using an air-lifting process. The drilling tool has a drilling head equipped at its lower surface with curing elements, whose upper surface is connected to hollow drilling rods having an inner conveying channel and from whose lower surface boring material mixed with a rinsing liquid is removed via the conveying channel. At the lower surface of the drilling tool head, inside a radial channel connected to the conveying channel, a cross-flow of the rinsing liquid, flowing radially inwards and having a high flow velocity, is produced for the purpose of carrying along the boring material.

44 Claims, 3 Drawing Sheets

52
100
50
51
A
1
L
53
24
10
11
FB
F
10
4
7'
21
6
22
13
5
8
9
Q
6
7
3
2
20

DRILLING TOOL FOR THE AIR-LIFTING PROCESS

This patent application is a continuation of application Ser. No. 09/214,585 filed on Dec. 31, 1998 now abandoned, which is a 371 of PCT/DE 97/00966 filed May 14, 1997.

The invention concerns a process and a device for drilling bore holes into the ground while the boring material is removed via the air lifting process.

BACKGROUND OF THE INVENTION

Drilling tools in this type of tool family and the airlift drilling process are known from the state of the art. When there is a removal of material according to the air-lifting process (reverse circulation), there is a column of liquid in the internal cross-section of the hollow drilling rod, which forms an extraction channel, and air is blown into this extraction channel of the drilling rod above the tool head, so a difference in pressure of the column of liquid in the drilling rod arises between the base of the bore hole and the surface because of the air rising in the drilling rod. The difference in pressure induces a velocity of flow with which the material that has been detached at the base of the bore hole is driven out through the internal cross-section of the drilling rod. The magnitude of the difference in pressure, and thereby the transporting capacity, depends among other things on the amount of air blown in per unit of time, on the depth to which it is blown in and on the lifting height. The material detached from the cutting element is suctioned up from the base through a suction opening; in the process, the suction opening can be centrally located on the bottom side of the tool head or, if the tool head has a pilot tip, for example, on a position offset from the center by around ¼ of the diameter.

When "suctioning up" is being discussed here and below, it is not thereby meant that a suction pump should be installed on the drilling rod. A pump is merely involved in order to press in air under high pressure through the drilling tool into the extraction channel. The hydrostatic pressure on the base of the bore hole is, however, higher than further up in the extraction channel in the mixture that exists there of water, drilled material and air. The transport actually takes place because of the higher pressure in the area of the base of the bore hole, but there is still a lower pressure in the extraction channel, and for simplification of expression "suctioning up" is talked about in this sense of a junction in an area of lower pressure.

In the case of the drilling tools known from the state of the art, the suction openings are usually designed so as to be circular or oval. In the case of some of the known drilling tools, several suction openings have been arranged, instead of one, distributed over the active surface of the drilling tool, in order to be able to achieve a suctioning of the material as close as possible to each cutting element. This is necessary so that the drilled material detached by the cutting elements is transported away as quickly as possible after it is detached from the base of the bore hole, and so that the drilling tool does not ineffectively operate on a layer of detached, drilled material left behind on the base of the bore hole. The arrangement last mentioned of the suction openings on several points arranged so as to vary in a radial direction requires an expensive arrangement of pipelines to connect the suction openings to the internal cross-section of the drilling rod forming the central extraction channel.

A drilling tool is known from U.S. Pat. No. 3,951,220 in which the suction openings are designed so as to be spiral shaped, so that a flow of the scavenging liquid directed from the outside to the inside is generated. It is a disadvantage, in the case of this drilling tool, that the flow is not sufficient to take larger amounts of loosened, drilled material along with it.

SUMMARY OF THE INVENTION

The problem involved with the invention is to create a drilling tool with efficient suctioning behavior, with which the material detached by the cutting elements is nearly completely suctioned up from the base of the bore hole, without the occurrence of a repeated interaction of the cutting elements with the material that has already been detached.

This task is implemented, with regard to technology and process, by providing a process for drilling bore holes into the ground while the boring material is being removed via an air lifting process by means of a drilling tool that is provided with a drilling head. The drilling head is equipped at its lower surface with cutting elements, and its upper surface is connected to hollow drilling rods having an inner conveying channel and from whose lower surface boring material mixed with the rinsing liquid is removed via the conveying channel. The cross-flow of the rinsing liquid, flowing radially inwards and having a high flow velocity, is produced at the lower surface of the drilling tool head for the purpose of carrying along the boring material.

A cross-current of the scavenging liquid running in a radial direction towards the center of the drilling tool head is generated on the active surface of the drilling tool head during the drilling; the flow rate of the cross-current is high enough to take in the material that has been detached and take it along. In the process, a lifting effect is achieved by means of the velocity of flow, which increases on the whole the suctioning behavior at the active surface and thereby the effectiveness of the air-lifting process. Because of the rotation of the drilling tool during the drilling, the crosscurrent is moved once completely over the entire cross section of the base of the bore hole per revolution of the drilling tool, so the cutting elements interact in each case with a "cleaned out" bore hole base.

In order to increase the lifting effect of the cross-current, fluid currents that are directed from out of the drilling tool head in a downwards direction can be superimposed on this cross-current. The effectiveness of the suctioning is further increased with these "turbulence-style", superimposed fluid currents, because even comparatively heavy drilled material is lifted to be pulled along by the cross-current.

The task of the invention with regard to its function as an apparatus is implemented by a drilling tool for drilling bore holes into the ground while the boring material is being removed via the air lifting process. The drilling tool is equipped with a drilling head whose upper surface is connected to hollow drilling rods. The hollow drilling rods have an inner conveying channel to remove the boring material. The lower surface of the drilling head is provided with cutting elements, distributed across its cross-section, and with at least one suction opening. The suction opening is connected to the conveying channel for the boring material mixed with the rinsing liquid. The suction opening is designed as a radially-extending channel, open below, whose end located towards the center is in a fluid connection with the conveying channel.

In the case of the drilling tool in accordance with the invention, the suction opening is designed as an oblong channel that is open at the bottom and that extends in a radial direction, in which a cross-current is generated from the outside to the center of the extraction channel of the drilling rod. An opening is located on the external end of the channel, in its upper wall, through which the liquid from the area of the base of the bore hole can additionally enter, so that a higher speed of the cross-current can be achieved.

The channel is preferably closed up to the end of the drilling tool head out to the periphery. The cross-current is prevented from bringing about a "bulging out" of the bore hole, especially in soft stone, because of the closed design of the channel out to the periphery. In one embodiment, the outer end of the channel is radially closed.

When operating, the suction opening, designed to be channel-shaped, is guided over the entire cross section of the base of the bore hole during each revolution, and the material that has been drilled loose is transported by the cross-current through the internal cross section of the drilling rod to the surface.

In order to avoid a clogging of this opening, especially in the case of drilling at low bore hole depths or in soft stone, a tubular element that extends upwards can be provided at the opening.

According to a preferred design, the outer end of the channel is provided at its upper wall with an opening serving as an additional inlet for fluid from the area of the bore hole base, so that a higher cross-flow speed can be obtained. In order to avoid clogging of this opening, particularly when drilling at low bore hole depths or in soft rock, the opening may be provided with a pipe-shaped element extending upwards. In one embodiment, an opening serving as an inlet for the clean rinsing liquid is arranged at the outer end of the channel at the upper part of its wall. In another embodiment, the opening is provided with a pipe-shaped element extending upwards.

Equipment can be provided to feed the scavenging agent to the opening in an accelerated manner and to strengthen the cross-current.

Components that influence the flow can be arranged in the channel to improve the lifting effect, and/or the wall surfaces of the channel can be designed so as to be helix-shaped or screw-shaped, so that turbulent flow behavior can be achieved in the cross-current. In one embodiment, the channel is surrounded by walls whose side facing the inside of the channel is provided with a flow-influencing profile.

Nozzles or jets that are directed downwards and fed through an air line can additionally be installed that increase the lifting effect of the detached material by whirling it up. In one embodiment, at least one side of the channel is provided with jets, essentially directed downwards and fed by air or rinsing liquid, for the purpose of whirling-up loosened material.

In order to achieve an adequate supply of the cross-current with scavenging liquid, at least one additional supply line for the scavenging liquid and/or one additional supply line for the air can extend along the drilling rod. For special applications, the tool head can be designed in such a way that drilling is possible from out of a support pipe. In one embodiment, at least one additional air inlet pipe and/or one additional inlet pipe for the rinsing liquid is/are arranged extending along the drilling rods.

In summary, there is provided a process for drilling bore holes into the ground while the boring material is being removed via an air lifting process by means of a drilling tool that is provided with a drilling head. The drilling head is equipped at its lower surface with cutting elements, and its upper surface is connected to hollow drilling rods having an inner conveying channel. The boring material at the lower surface of the drilling head is rinsing liquid and is removed via the conveying channel. The cross-flow of the rinsing liquid, flowing radially inwards and having a high flow velocity, is produced at the lower surface of the drilling tool head for the purpose of carrying along the boring material. In one arrangement, additional flows are superimposed on the cross-flow. In another arrangement, there is provided a drilling for drilling bore holes into the ground while the boring material is being removed via an air lifting process. The drilling tool is equipped with a drilling head whose upper surface is connected to hollow drilling rods. The hollow drilling rods have an inner conveying channel to remove the boring material. The lower surface of the drilling head is provided with cutting elements, distributed across its cross-section, and with at least one suction opening. The suction opening is connected to the conveying channel for the boring material mixed with the rinsing liquid. The suction opening is designed as a radially-extending channel, open below, whose end located towards the center is in a fluid connection with the conveying channel. In still another arrangement, the outer end of the channel is radially closed. In yet another arrangement, an opening serving as an inlet for the clean rinsing liquid is arranged at the outer end of the channel at the upper part of its wall. In still yet another arrangement, the opening is provided with a pipe-shaped element extending upwards. In a further arrangement, the rinsing liquid can be passed to the opening in an accelerated way. In yet a further arrangement, components influencing the flow are arranged inside the channel. In still a further arrangement, the channel is surrounded by walls whose side facing the inside of the channel is provided with a flow-influencing profile. In still yet a further arrangement, at least one side of the channel is provided with jets essentially directed downwards and fed by air or rinsing liquid, for the purpose of whirling-up loosened material. In another arrangement, at least one additional air inlet pipe and/or one additional inlet pipe for the rinsing liquid is/are arranged extending along the drilling rods. In still another arrangement, the tool head is designed in such a way that it can be used for drilling from a supporting rod.

Further design developments and advantages of the invention are evident from the following description of three design examples, with reference to the drawing.

DESCRIPTION OF THE PREFERRED EMBODIMENTS

Figure 1:
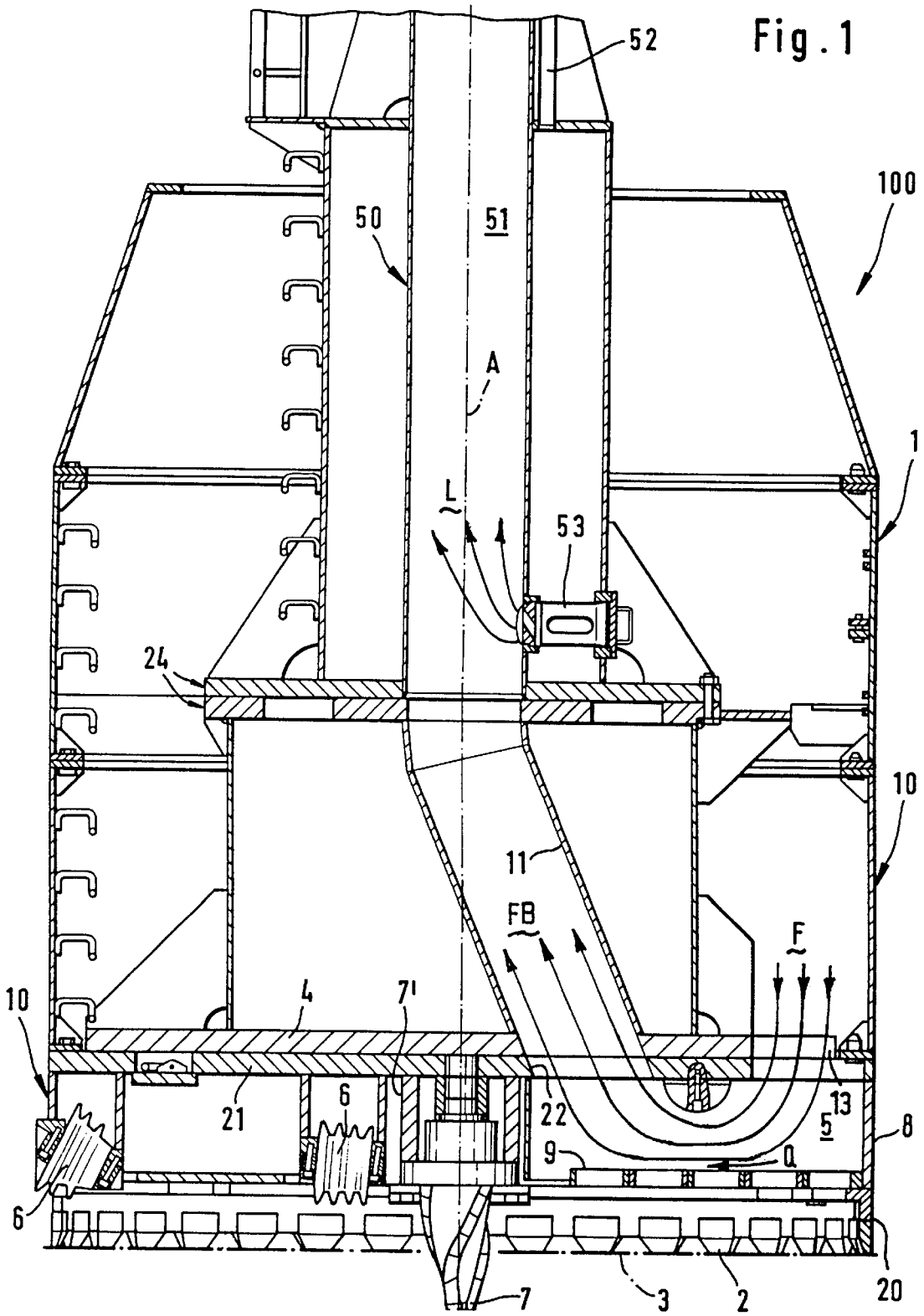
FIG. 1 shows a drilling tool with a level active surface in a side view in a profile section that goes through the drilling axis.

The drilling tool 100 shown in FIG. 1 has a barrel-shaped housing 1 with a diameter that can be as large as a few meters, depending on the bore hole diameter. A tool head 10 of the same diameter is attached to the bottom side of the housing 1; cutting elements 2 designed in the form of hard carbide inserts are arranged on the underside 20 of the tool head in such a way that the drilling tool 100 has a flat active surface 3 described by a dash-dot segmentation on the whole. Roller bit drilling tools 6 that are distributed over the active surface supplement the cutting elements 2. The tool head 10 has a connecting plate 21 on its top surface; the connecting plate can be connected to the bottom surface of the housing 1 with a connecting flange 4. The housing 1 in turn is connected with a hollow drilling rod 50, which can be put into rotation around the drilling axis A by a rotary drive unit, which is not depicted, engaging at its upper end. The internal cross section of the drilling rod 50 forms an extraction channel 51 and serves to excavate the drilled material according to the air-lifting process. The extraction channel 51 of the drilling rod 50 extends in a direction that is coaxial to the drilling axis A up to a flange connection 24 that is perpendicular to the drilling axis A approximately in which is located approximately halfway down the side of casing 1; conveying channel 51 then converges into a suction pipe 11, arranged at a slight incline within the tool head 10. For the design type shown, the suction pipe 11 converges from the center (at the level of the flange connection 24) at an angle of approximately 20° into a through opening 22 of the upper connecting plate 21 of the drilling head 10. The through opening 22 is positioned close to the drilling axis A and is connected to a suction opening designed as a radially extending channel 5. The distance of that end of channel 5 close to the drilling axis A is determined by the dimensions of the holding fixture 7' of a pilot point 7 projecting downwards from the drilling head 10, in the drilling axis A. Channel 5 has a U-shaped cross-section, open below, it extends radially outwards from the center and is closed off at the circumferential edge of the tool head 10 by the casing wall 8 located there. The cross section of channel 5, shown in FIG. 3, remains constant along the entire length of channel 5. For the design type shown, a grille 9 is provided at the open bottom of channel 5 in order to limit the size of the lumps of material entering channel 5. As is clearly shown in FIG. 2, channel 5 is arranged at only one point, as viewed in the direction of circumference, at the lower surface 20 of the tool head 10.

During operation, the conveying channel 51 of the drilling rods 50 and the suction pipe 11 converging into channel 5 are filled with the rinsing liquid, usually water. An air-inlet jet 53 located at the lower end of conveying channel 51 serves for the injection of air L, via a pipe 52 extending along the drilling rods 50, upwards into the conveying channel 51. The injection of the air L causes the difference in pressure between the boring hole base and inside the drilling rods 50. Following the decrease in pressure, the liquid is forced from the high pressure area at the bore hole base into the area of lower pressure inside the conveying channel 51. Due to the resulting strong flow, the boring material loosened and crushed at the bore hole base by the cutting elements 20 and the roller drills 6 is swept along and is conveyed to the surface via conveying channel 51 as a mixture B of rinsing liquid F and boring material B. Due to the radial extension of channel 5, a cross-flow, indicated by the arrow marked Q, occurs within channel 5 during operation, whereby the loosened boring material is collected along the entire radial extension of the channel 5 and is conveyed to the suction pipe 11 or the central conveying channel 51, respectively. Due to the fact that channel 5 is closed off at the circumferential edge by means of the casing wall 8, material is prevented from being washed out of the bore hole wall in an undesirable manner.

Suction channel 5 passes over the entire cross-section of the bore hole base during a 360° rotation due to the rotating movement of the drilling tool 100, so that during the air lifting process an automatic "cleansing" of the bore hole base occurs due to the cross-flow Q, as indicated by arrows, and the cutting elements 2, 6 do not have to work with already loosened material.

In order to intensify the cross-flow Q within suction channel 5, the outer end of suction channel 5 close to the casing wall 8 of the upper surface of channel 5 is provided with an opening 13 serving as an inlet for the clean rinsing liquid F; this liquid enters channel 5 at its outer end and exits channel 5 at its inner end via the through opening 22, passing upwards into the suction pipe 11 as the now-loaded rinsing liquid FB.

Figure 2:
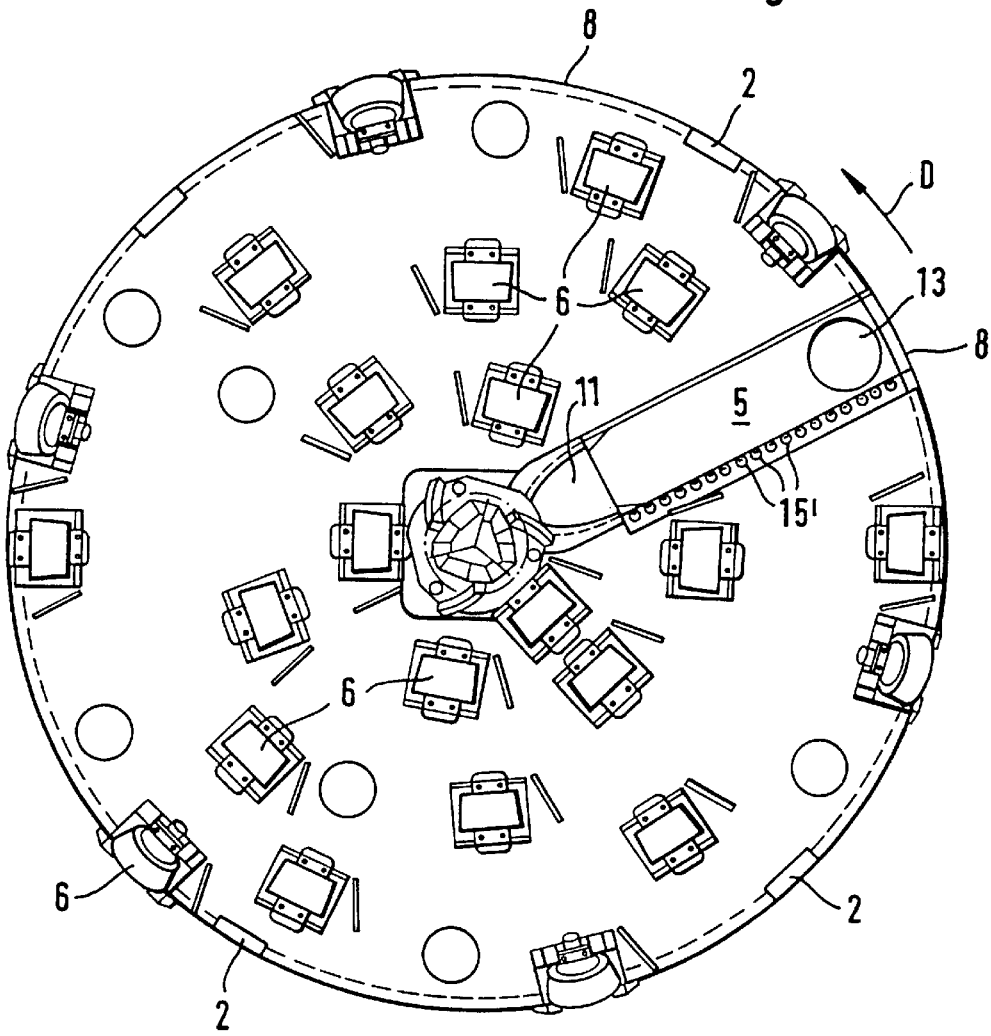
FIG. 2 shows a view of the active surface of the drilling tool head in accordance with FIG. 1 from below.
Figure 3:
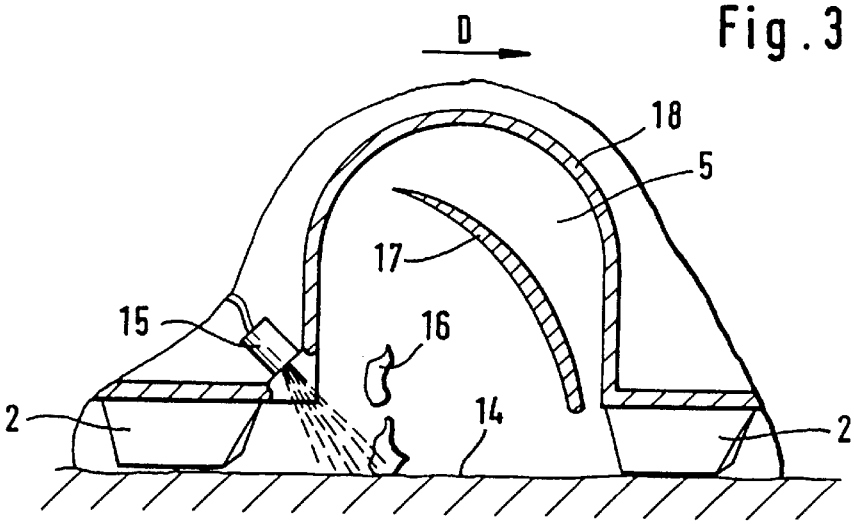
FIG. 3 shows a cross section through a suction channel.

In order to increase the lifting effect of cross-flow Q, jets 15 may be provided which are directed from the sides of channel 5 towards the bore hole base 14; even rather large lumps of material 16 which are not easily swept along by the cross-flow Q, can be lifted by means of these jets 15, so that they can then be conveyed via cross-flow Q into conveying channel 5 and thence to the surface. As shown in FIG. 2, several such jets 15' are preferably arranged along channel 5 in order to obtain an evenly-distributed additional whirling effect. Jets 15 are fed by air or water and are arranged in such a way that the jet-stream direction of the jets 15 is the same as the rotating direction D of the drilling tool 100.

Instead of or in addition to the jets 15, components serving to influence the flow such as guiding surfaces 17 (cf. FIG. 3) may be arranged inside channel 5, for the purpose of directing a spin into the cross-flow Q which further increases the lifting effect on the lumps of rock 16 lying at the bore hole base. As an alternative, the wall 18 of channel 5 may be provided with a screw- or spiral-shaped profile, or with indentations or scoring, in order to obtain an additional spin within cross-flow Q in this way. Due to the additional spin within the cross-flow, boring material can also be lifted out of the indentations at the bore hole base 14 caused by the cutting elements 2.

Figure 4:
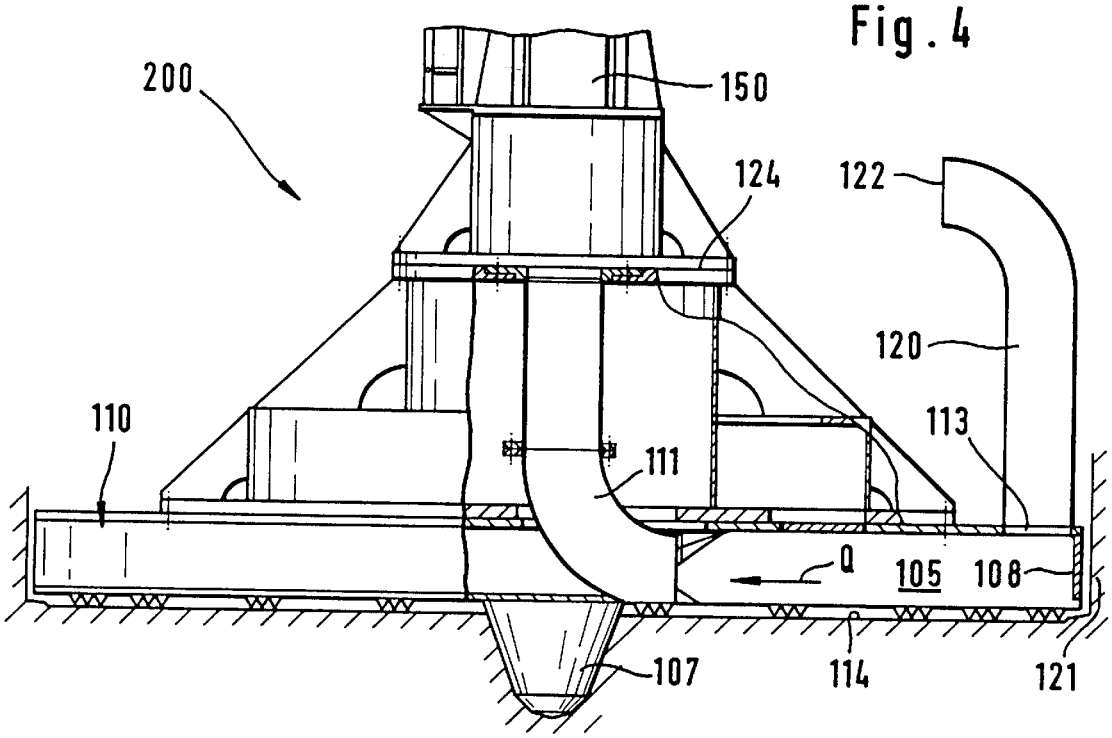
FIG. 4 shows a sectional view corresponding to FIG. 1 of a further design example of the drilling tool.

The lower limits of channel 105 inside drilling head 110 of the drilling tool 200, shown in FIG. 4, is positioned especially close to the bore hole base 114, whereby the suction pipe 111 is designed as a pipe elbow converging into channel 105 in the longitudinal direction of that channel, i.e. without any abrupt deflection. Due to this difference in construction, the suction pipe 111 and the pilot point 107 do not obstruct each other. At its upper end the suction pipe passes into the drilling rods 150, at the level of the flange connection 124. A pipe section 120 is welded to the opening 113 positioned close to the casing wall 108; this pipe section 120 extends upwards and its upper end is bent towards the center, i.e. away from the wall of the drilling hole, in order to prevent the inlet opening 122 from being clogged by any material dropping or sliding into the drilling hole.

A "free" suctioning of the rinsing liquid at the radially outer end of channel 5, 105 from above takes place in the case of the design types shown. By means of additional inlet pipes, extending along the drilling rods 50, 150 and serving to supply rinsing liquid under high pressure from the outside to the outer opening, a cross-flow of increased velocity can be obtained within the channel 5, 105, whereby the suction capacity and thus the total efficiency of the drilling tool 100, 200 can be further increased.

Figure 5:
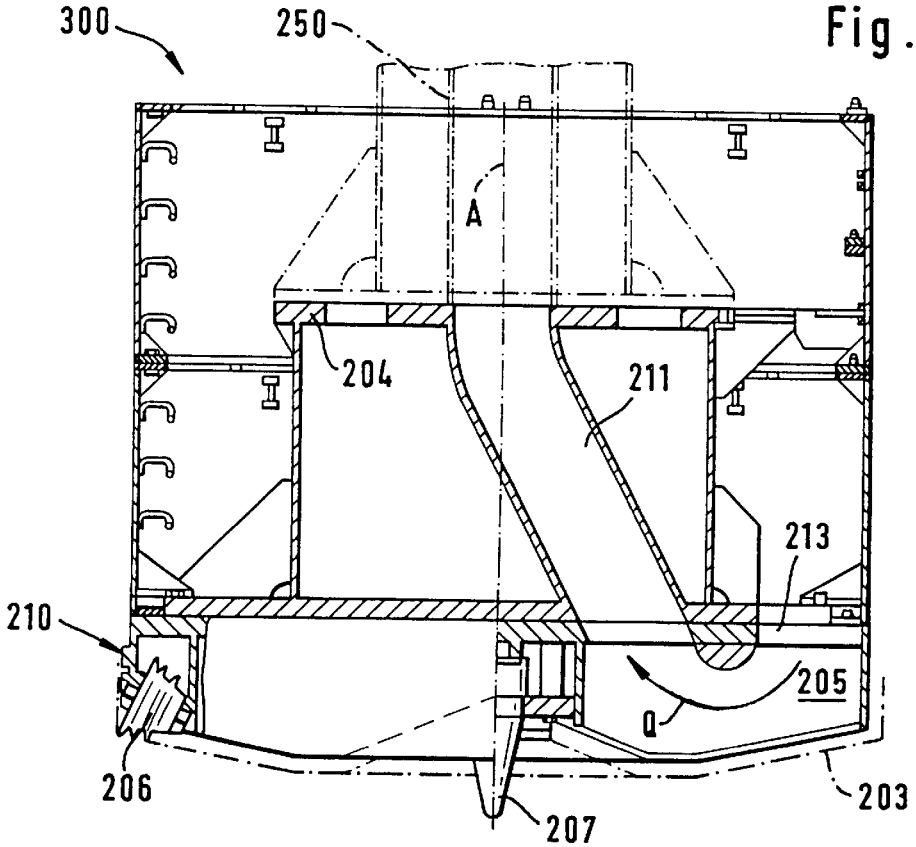
FIG. 5 shows a sectional view corresponding to FIG. 1 of a third design example of a drilling tool with a W-shaped active surface.

For the drilling tool 300, shown in FIG. 5, the effective surface 203 of the tool head 210, which is determined by the roller cutting elements 206 (only one is shown here), is designed as a W-shape, when viewed as a section through the drilling axis A. First-rate results were obtained for drilling tools having W-shaped effective surfaces when the diameter of the drilling tool was approximately 3.60 m, and the flow speeds of the cross-flow Q were approximately 3 m per second. The W-shape which differs from the flat shape of the effective surface interacts with the spin effect, directed towards the bore hole base, of the cross-flow Q within the channel 205, so that an especially efficient lifting effect as well as the efficient conveyance of the lifted boring material via the suction channel 211 and the drilling rods 250 were obtained.

The drilling tools 100 and 300, respectively, shown in FIG. 1 and FIG. 5, are particularly suitable when drilling is done from the support rods.

I claim:

1. A drilling tool for drilling bore holes in the ground, and for the removal of drilled material using an air-lifting process comprising a drilling tool head having a hollow drilling rod with an internal extraction channel to remove the drilled material from the top of the drilling tool head, said drilling tool head having a plurality of cutting elements on a bottom surface distributed over a cross section of said bottom surface, and one suction channel positioned at least closely adjacent to said bottom surface, said suction channel having a first end, a second end, two side walls extending therebetween, a suction opening and an inlet opening, said first end position off center of said drilling tool head and said second end position at least closely adjacent to an outer periphery of said drilling tool head, said suction opening positioned at least closely adjacent to said first end and providing fluid communication between said suction channel and said extraction channel, said inlet opening positioned at least closely adjacent to said second end and providing an entrance into said suction channel for a scavenger fluid to initially contact said drilled material and to radially move at least a portion of said drilled material to said suction opening, said cutting elements positioned outside said suction channel.

2. The drilling tool as defined in claim 1, wherein said side walls of said suction channel has a substantially linear shape between said first end and said second end.

3. The drilling tool as defined in claim 2, wherein said suction channel having a substantially uniform cross-sectional shape, said cross-sectional shape having an arcuate portion.

4. The drilling tool as defined in claim 3, wherein said suction channel having a substantially uniform cross-sectional shape, said cross-sectional shape being a substantially inverted U-shaped.

5. The drilling tool as defined in claim 1, wherein said suction channel having a substantially uniform cross-sectional shape, said cross-sectional shape having an arcuate portion.

6. The drilling tool as defined in claim 1, wherein said second end of said suction channel includes a wall portion connected to said drilling tool head, said wall portion causing substantially all of said scavenger fluid flowing through said inlet opening and into said suction channel to flow towards said first end of said suction channel.

7. The drilling tool as defined in claim 2, wherein said second end of said suction channel includes a wall portion connected to said drilling tool head, said wall portion causing substantially all of said scavenger fluid flowing through said inlet opening and into said suction channel to flow towards said first end of said suction channel.

8. The drilling tool as defined in claim 5, wherein said second end of said suction channel includes a wall portion connected to said drilling tool head, said wall portion causing substantially all of said scavenger fluid flowing through said inlet opening and into said suction channel to flow towards said first end of said suction channel.

9. The drilling tool as defined in claim 1, wherein said suction channel includes at least one spray jet to direct additional fluid into said suction channel, said at least one spray jet positioned between said inlet opening and said suction opening.

10. The drilling tool as defined in claim 2, wherein said suction channel includes at least one spray jet to direct additional fluid into said suction channel, said at least one spray jet positioned between said inlet opening and said suction opening.

11. The drilling tool as defined in claim 7, wherein said suction channel includes at least one spray jet to direct additional fluid into said suction channel, said at least one spray jet positioned between said inlet opening and said suction opening.

12. The drilling tool as defined in claim 8, wherein said suction channel includes at least one spray jet to direct additional fluid into said suction channel, said at least one spray jet positioned between said inlet opening and said suction opening.

13. The drilling tool as defined in claim 9, wherein said at least one spray jet directing a fluid downwardly and laterally at a direction substantially tangential to the side wall of said suction channel.

14. The drilling tool as defined in claim 12, wherein said at least one spray jet directing a fluid downwardly and laterally at a direction substantially tangential to the side wall of said suction channel.

15. The drilling tool as defined in claim 9, wherein said bottom surface of said drilling tool head rotates said cutting elements about the central axis of said drilling tool head, said at least one spray jet directing fluid in the direction of rotation of said bottom surface of said drilling tool head.

16. The drilling tool as defined in claim 13, wherein said bottom surface of said drilling tool head rotates said cutting elements about the central axis of said drilling tool head, said at least one spray jet directing fluid in the direction of rotation of said bottom surface of said drilling tool head.

17. The drilling tool as defined in claim 14, wherein said bottom surface of said drilling tool head rotates said cutting elements about the central axis of said drilling tool head, said at least one spray jet directing fluid in the direction of rotation of said bottom surface of said drilling tool head.

18. The drilling tool as defined in claim 9 wherein said suction channel includes a base, said base positioned above the surface of said ground, said at least one spray jet positioned at least closely adjacent to said base.

19. The drilling tool as defined in claim 16, wherein said suction channel includes a base, said base positioned above the surface of said ground, said at least one spray jet positioned at least closely adjacent to said base.

20. The drilling tool as defined in claim 1, wherein said suction channel includes a screen positioned along at least a portion of a base of said suction channel, said screen controlling the size of drilled material entering said suction channel.

21. The drilling tool as defined in claim 2, wherein said suction channel includes a screen positioned along at least a portion of a base of said suction channel, said screen controlling the size of drilled material entering said suction channel.

22. The drilling tool as defined in claim 6, wherein said suction channel includes a screen positioned along at least a portion of a base of said suction channel, said screen controlling the size of drilled material entering said suction channel.

23. The drilling tool as defined in claim 11, wherein said suction channel includes a screen positioned along at least a portion of a base of said suction channel, said screen controlling the size of drilled material entering said suction channel.

24. The drilling tool as defined in claim 9, wherein said suction channel includes a screen positioned along at least a portion of a base of said suction channel, said screen controlling the size of drilled material entering said suction channel.

25. The drilling tool as defined in claim 17, wherein said suction channel includes a screen positioned along at least a portion of a base of said suction channel, said screen controlling the size of drilled material entering said suction channel.

26. The drilling tool as defined in claim 1, wherein said suction channel includes at least one fluid guide to at least partially alter the flow path of said scavenger fluid as said scavenger fluid flows from said second to said first end of said suction channel.

27. The drilling tool as defined in claim 2, wherein said suction channel includes at least one fluid guide to at least partially alter the flow path of said scavenger fluid as said scavenger fluid flows from said second to said first end of said suction channel.

28. The drilling tool as defined in claim 6 wherein said suction channel includes at least one fluid guide to at least partially alter the flow path of said scavenger fluid as said scavenger fluid flows from said second to said first end of said suction channel.

29. The drilling tool as defined in claim 9, wherein said suction channel includes at least one fluid guide to at least partially alter the flow path of said scavenger fluid as said scavenger fluid flows from said second to said first end of said suction channel.

30. The drilling tool as defined in claim 20, wherein said suction channel includes at least one fluid guide to at least partially alter the flow path of said scavenger fluid as said scavenger fluid flows from said second to said first end of said suction channel.

31. The drilling tool as defined in claim 25, wherein said suction channel includes at least one fluid guide to at least partially alter the flow path of said scavenger fluid as said scavenger fluid flows from said second to said first end of said suction channel.

32. The drilling tool as defined in claim 1, wherein said suction channel includes a base, said base positioned above the surface of said ground, said base having a non-planar surface.

33. The drilling tool as defined in claim 2, wherein said suction channel includes a base, said base positioned above the surface of said ground, said base having a non-planar surface.

34. The drilling tool as defined in claim 6, wherein said suction channel includes a base, said base positioned above the surface of said ground, said base having a non-planar surface.

35. The drilling tool as defined in claim 20, wherein said suction channel includes a base, said base positioned above the surface of said ground, said base having a non-planar surface.

36. The drilling tool as defined in claim 20, wherein said suction channel includes a base, said base positioned above the surface of said ground, said base having a non-planar surface.

37. The drilling tool as defined in claim 31, wherein said suction channel includes a base, said base positioned above the surface of said ground, said base having a non-planar surface.

38. The drilling tool as defined in claim 1, wherein said drilling tool has a longitudinal central axis, said hollow drilling rod positioned in said longitudinal central axis at said top portion of said drilling tool, said hollow drilling rod including an angular lower portion positioned in a bottom portion of said drilling tool, said angular lower portion deviating from said longitudinal central axis to connect to said first opening of said suction channel.

39. The drilling tool as defined in claim 2, wherein said drilling tool has a longitudinal central axis, said hollow drilling rod positioned in said longitudinal central axis at said top portion of said drilling tool, said hollow drilling rod including an angular lower portion positioned in a bottom portion of said drilling tool, said angular lower portion deviating from said longitudinal central axis to connect to said first opening of said suction channel.

40. The drilling tool as defined in claim 37, wherein said drilling tool has a longitudinal central axis, said hollow drilling rod positioned in said longitudinal central axis at said top portion of said drilling tool, said hollow drilling rod including an angular lower portion positioned in a bottom portion of said drilling tool, said angular lower portion deviating from said longitudinal central axis to connect to said first opening of said suction channel.

41. The drilling tool as defined in claim 1, including means for feeding said scavenging liquid into said inlet opening in an accelerated fashion.

42. The drilling tool as defined in claim 40, including means for feeding said scavenging liquid into said inlet opening in an accelerated fashion.

43. The drilling tool as defined in claim 1, including at least one supply line connected to said extraction channel to direct a fluid upwardly into said extraction channel.

44. The drilling tool as defined in claim 42, including at least one supply line connected to said extraction channel to direct a fluid upwardly into said extraction channel.

* * * * *